US005287787A

United States Patent [19]

Satoshi

[11] Patent Number: 5,287,787

[45] Date of Patent: Feb. 22, 1994

[54] UPRIGHT PIANO FOR CONSTANT KEY-TOUCH REGARDLESS OF MANIPULATION OF SOFT PEDAL

[75] Inventor: Inoue Satoshi, Shizuoka, Japan

[73] Assignee: Yamaha Corporation, Hamamatsu, Japan

[21] Appl. No.: 925,793

[22] Filed: Aug. 4, 1992

[30] Foreign Application Priority Data

Aug. 6, 1991 [JP] Japan ..... 3-196884

[51] Int. Cl.[5] ..... G10C 3/18

[52] U.S. Cl. ..... 84/240; 84/217

[58] Field of Search ..... 84/217, 218, 221, 236, 84/240

[56] References Cited

U.S. PATENT DOCUMENTS 4,061,067 12/1977 Carbone ..... 84/236

5,196,638 3/1993 Hayashida et al. ..... 84/240

*Primary Examiner*—Michael L. Gellner

*Assistant Examiner*—P. Stanzione

*Attorney, Agent, or Firm*—Spensley Horn Jubas & Lubitz

[57] ABSTRACT

A jack on a whippen incorporated in an upright piano drives a hammer assembly to rotate toward musical strings for producing sound, and a soft pedal causes the hammer assembly to become closer to the musical strings, wherein the upright piano comprises an adjusting mechanism operative to move the whippen upon manipulation of the soft pedal for eliminating gap between the jack and the butt as well as modifying rotating distance of the whippen, and a driving link assembly coupled between an associated key and a damper mechanism so that the whippen moved by the adjusting mechanism has no influence of action of the damper mechanism, thereby keeping key-touch ordinary under the manipulation of the soft pedal.

4 Claims, 4 Drawing Sheets

UPRIGHT PIANO FOR CONSTANT KEY-TOUCH REGARDLESS OF MANIPULATION OF SOFT PEDAL

FIELD OF THE INVENTION

This invention relates to an upright piano and, more particularly, to a key action mechanism for constant keytouch regardless of manipulation of pedal mechanisms.

DESCRIPTION OF THE RELATED ART

In general, the upright piano is equipped with a soft pedal mechanism for lessening volume of sounds. Namely, while a player performs on the keyboard, he intends to lessen a sound, and depresses the soft pedal. The depressed soft pedal causes hammers to be close to the associated musical strings. Thereafter, when the player depresses a key, the key action mechanism allows the associated hammer to strike the musical strings after travel over a decreased distance, and the sound thus produced is smaller in volume than a sound produced without depressing the soft pedal. However, when the hammer becomes closer to the associated musical strings, gap takes place between the jack and the butt supporting the hammer shank, and the player feels the key-touch strange.

The gap between the jack and the butt is causative of the strange feeling, and Japanese Utility Model Application laid-open 52-9492 discloses a mechanism which lifts the whippen upon depressing the soft pedal so as to allow the jack to be held in contact with the butt at all times. Although the lifting mechanism disclosed in the Japanese Utility Model Application can eliminate lost motion from the transmission of the key action, the transmission line of the key action is identical with that of the key action without depressing the soft pedal, and, accordingly, the whippen travels the same path. Since the whippen is previously lifted, the jack escapes from the butt earlier than that without depressing the soft pedal, and the early escape gives the player different strange feeling.

The present inventor proposed to decrease the rotating distance of the whippen together with the decrement of the traveling path of the hammer. Namely, in order to eliminate the strange feelings, when the player depresses the soft pedal, the point of action from the key to the whippen is moved toward the balance key pin.

The prior art upright piano is further equipped with a damper mechanism linked with each key. If the player depresses a key without manipulating the damper pedal, the damper spoon on the whippen urges the damper lever so that the damper felt members are released from the associated musical strings. The whippen allows the hammer to strike the musical strings, and the musical strings vibrate for producing sound. Upon releasing the key, the damper felt members are brought into contact with the musical strings again, and forcibly damp the musical strings.

Thus, the whippen relates to the action of the soft pedal as well as to the action of the damper mechanism in the key action mechanism previously proposed by the present inventor. Namely, while the soft pedal is depressed, the soft pedal mechanism changes the point of action between the key and the whippen as described hereinbefore. However, the point of action thus changed affects the motion of the damper lever and the action timing thereof, because the movement of the whippen changes the distance between the damper lever and the damper spoon. In other words, the damper felt members are brought into contact with and released from the musical strings under manipulation of the soft pedal at different timings from the standard key-on without manipulation of the soft pedal. Such different timings give the player difficulty in musical expression. Moreover, if the damper spoon becomes too close to the damper lever under manipulation of the soft pedal, the damper spoon urges the damper lever before key-on, and the damper felt members can not damp the musioal strings.

SUMMARY OF THE INVENTION

It is therefore an important object of the present invention to provide an upright piano which is free from the drawbacks inherent in the prior art upright piano.

To accomplish the object, the present invention proposes to drive a damper lever with a kicker independent from a whippen.

In accordance with the present invention, there is provided an upright piano comprising: a) a keyboard having at least one key rotatable with respect to a center axis, a first capstan button projecting from the at least one key; b) at least one set of musical strings provided in association with the at least one key; c) at least one hammer assembly having a butt, and rotatable from a home position toward the at least one set of musical strings for striking the at least one set of musical strings when the at least one key is depressed; d) at least one key action mechanism having a rotatable whippen, a whippen heel attached to one surface of the whippen and a jack coupled with the whippen and held in contact with the butt, and operative to drive the at least one hammer assembly for rotation toward the at least one set of musical strings when the at least one key is depressed; e) at least one damper mechanism having a rotatable damper lever held at a home position while the at least one key is released, and a first absorber supported by the rotatable damper lever and held in contact with the at least one set of musical strings while the rotatable damper lever is held at the home position, the damper lever allowing the first absorber to be spaced from the at least one set of musical strings when the at least one key is depressed; f) a pedal mechanism linked with a soft pedal, and having a damper rail associated with a second absorber, the second absorber being spaced from the at least one hammer assembly while the soft pedal is released, the pedal mechanism causing the at least one hammer assembly to become closer to the at least one set of musical strings when the soft pedal is depressed; g) an adjusting mechanism linked with the soft pedal, and having a second capstan button projecting from the at least one key and closer to the center axis of the at least one key than the first capstan button, a drive button spaced from the whippen heel when the soft pedal is released, and a transmission means slidable on the second capstan button and allowing the drive button to urge the whippen heel in a direction to increase distance between the first capstan button and the whippen heel when the soft pedal is depressed; and h) a driving link assembly driven for rotation independently from the whippen, and transmitting a key motion produced upon depressing the at least one key to the damper lever in a direction allowing the first absorber to be spaced from the at least one set of musical strings.

BRIEF DESCRIPTION OF THE DRAWINGS

The features and advantages of the upright piano according to the present invention will be more clearly understood from the following description taken in conjunction with the accompanying drawings in which.

DESCRIPTION OF THE PREFERRED EMBODIMENTS

First Embodiment

Figure 1:
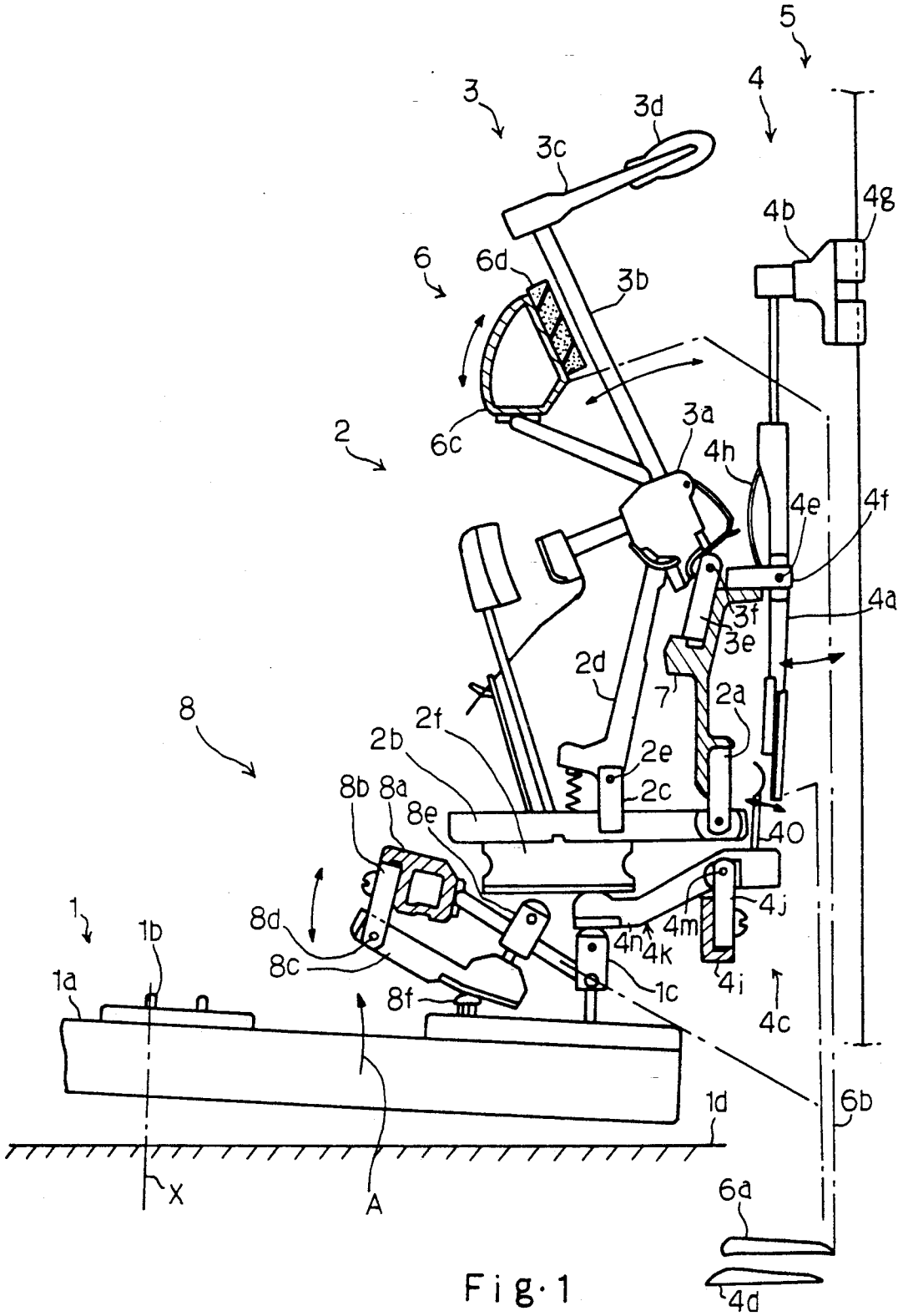
FIG. 1 is a partially cut-away side view showing a key action mechanism associated with a damper mechanism according to the present invention.

Referring first to FIG. 1 of the drawings, an upright piano embodying the present invention comprises a keyboard 1, a plurality of key action mechanisms 2 for transmitting key motions to a plurality of hammer assemblies 3, a plurality of damper mechanism 4 for damping musical strings 5 and a soft pedal mechanism 6. Although the keyboard 1 is implemented by a plurality of, typically 88, keys, only one of the keys is shown and labeled with reference 1*a* in FIG. 1, and description is made on the key action mechanism 2, the hammer assembly 3 and the damper mechanism 4 associated with the key 1*a*. However, the other key action mechanisms 2, the other hammer assemblies 3 and the other damper mechanisms 4 are similar in structure to those associated with the key 1*a*, and no further description is incorporated hereinbelow for the sake of simplicity.

The key 1*a* is swingablly supported by a balance key pin 1*b* on a key bed 1d horizontally placed, and is driven for rotation in a direction indicated by an arrow A. A first capstan button 1*c* is upright at the rear end portion of the key 1*a*, and is linked with the key action mechanism 2. The musical strings are vertically stretched with respect to the key bed 1*d*, and the hammer assembly 3 is spaced apart from the musical strings 5 while the associated key 1*a* is released. The hammer assembly 3 associated with the key 1*a* comprises a butt 3*a*, a hammer shank 3*b* projecting from the butt 3*a*, a hammer wood 3*c* coupled with the leading end of the hammer shank 3*b* and a hammer top felt 3*d* retained at the leading end of the hammer wood 3*c*. A center rail 7 extends substantially parallel to the key bed 1*d*, and a butt flange 3*e* is screwed to the center rail 7. The butt 3*a* is rotationally supported by the butt flange 3*e* by means of a pin member 3*f*.

The key action mechanism 2 associated with the key 1*a* is provided between the keyboard 1 and the hammer assembly 3, and has a whippen flange 2*a* downwardly projecting from the center rail 7. A whippen 2*b* is rotatablly supported by the whippen flange 2*a*, and a jack flange 2*c* is fixed to the whippen 2*b*. The jack flange 2*c* rotatablly supports a jack 2*d* so that the jack 2*d* is rotational around a pin member 2*e* connected to the jack flange 2*c*. A whippen heel 2*f* is coupled with the whippen 2*b*. The key motion is transmitted from the first capstan button 1*c* to the whippen 2*b*, and the whippen 2*b* relays the key motion through the jack 2*d* to the butt 3*a*.

The soft pedal mechanism 6 has a soft pedal 6*a*, a link assembly 6*b* and a hammer rail 6*c*, and a hammer rail cloth 6*d* is bonded to the hammer rail 6*c*. When the soft pedal 6*a* is depressed by a player, the link assembly 6*b* drives the hammer rail 6*c* for rotation, and the hammer rail cloth 6*d* urges the hammer assembly 3 to become closer to the musical strings 5. In other words, distance between the hammer top felt 3*d* and the associated musical strings 5 is decreased by the hammer rail driven by the soft pedal 6*a*.

Figure 2:
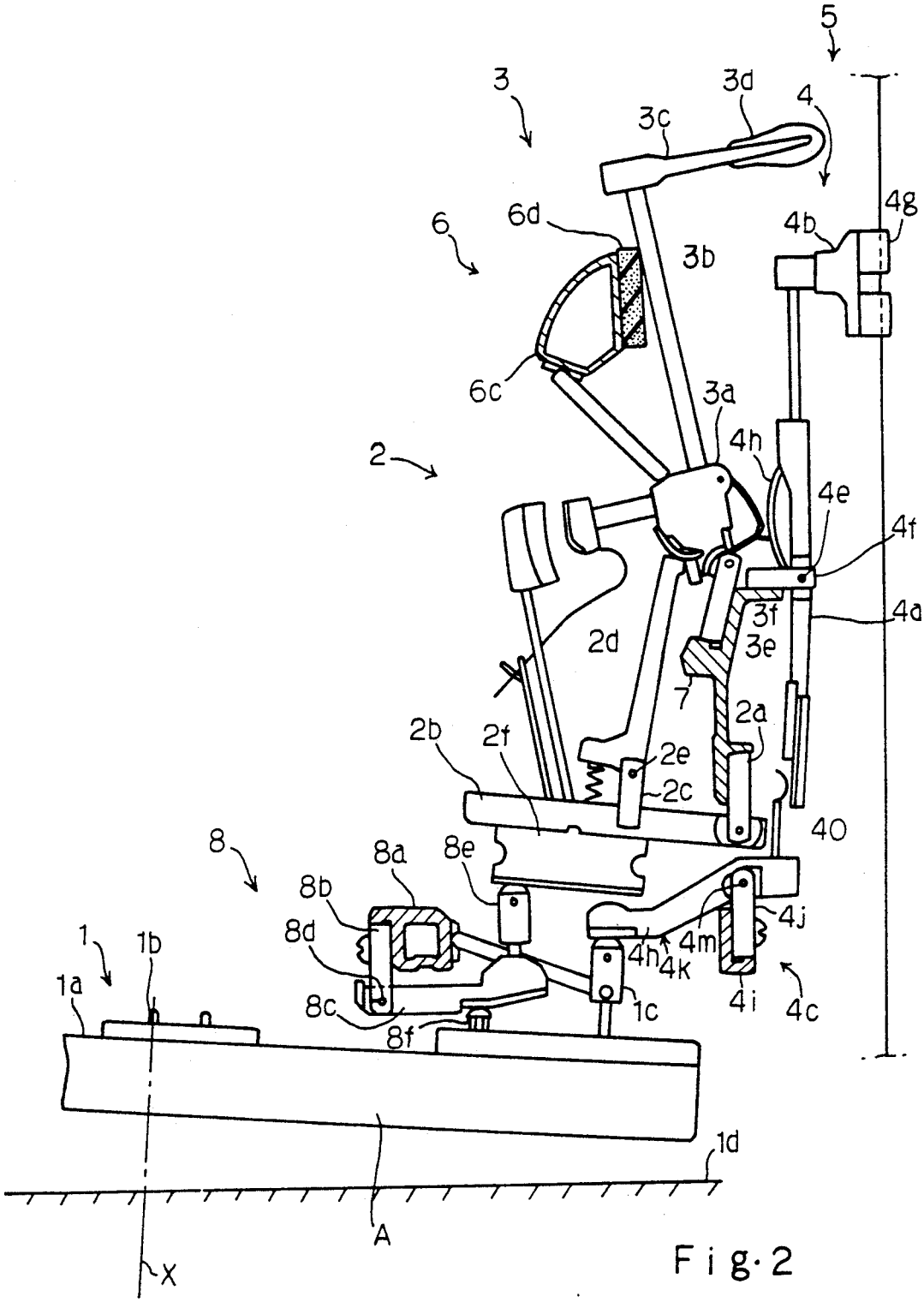
FIG. 2 is a partially cut-away side view showing the key action mechanism associated with the damper mechanism under manipulation of the soft pedal.

An adjusting mechanism 8 is further incorporated in the upright piano according to the present invention, and is provided in association with the key action mechanism 2. The adjusting mechanism 8 not only eliminates gap produced upon depressing the soft pedal 6*a* but also changes the rotating distance of the whippen 2*b*. The adjusting mechanism 8 comprises a bypass rail 8*a* horizontally extending and downwardly rotatable, a flange 8*b* fixed to the bypass rail 8*a*, a bypass lever 8*c* rotatable around a pin 8*d* connected to the flange 8*b*, a drive button 8*e* projecting from the leading end portion of the bypass lever 8*c*, and a second capstan button 8*f* implanted into the upper surface of the key 1*a* at a predetermined position closer to the first capstan button 1*c*. The bypass rail 8*a* is coupled with the soft pedal 6*a*, and is downwardly moved as shown in FIG. 2 when the soft pedal 6*a* is depressed. When the soft pedal 6*a* is released, the bypass rail 8*a* is upwardly moved, and is recovered to the initial position shown in FIG. 1. While the bypass rail 8*a* is downwardly moving, the bypass lever 8*c* slides on the top surface of the second capstan button 8*f*, and lifts the drive button 8*e*. Then, the drive button 8*e* is brought into contact with the whippen heel 2*f*. The bypass rail 8*a* further moves downwardly together with the soft pedal 6*a*, and the drive button 8*e* urges the whippen heel 2*f* and, accordingly, the whippen 2*b* upwardly. In this instance, the bypass rail 8*a*, the flange 8*b*, the bypass lever 8*c* and the links between the soft pedal and the bypass rail 8*a* as a whole constitute a transmission means.

As described hereinbefore, when the soft pedal is depressed, gap takes place between the butt and the jack in the prior art upright piano. In order to eliminate the gap as well as to adjust the whippen 2*f* to the final position without manipulation of the soft pedal 6*a*, the adjusting mechanism 8 is arranged between the whippen heel 2*f* and the rear potion of the key 1*a* with respect to the center axis X aligned with the balance key pin 1*b*. While the soft pedal 6*a* is released, the bypass rail is in the home position shown in FIG. 1, and the adjusting mechanism 8 never transmits the key motion to the whippen heel 2*f*. If the soft pedal 6*a* is depressed, the bypass rail 8*a* is moved to the position shown in FIG. 2, and the adjusting mechanism 8 transmits the key motion through the whippen heel 2*f* to the butt 3*a* without any lost motion, and terminates the whippen 2*b* at the same final position where the whippen 2*b* is terminated without manipulation of the soft pedal 6*a*. This is because of the fact that the rotating distance of the whippen 2*b* is modified.

The damper mechanism 4 comprises a damper lever 4*a*, a damper head 4*b*, a driving link assembly 4*c* and a damper pedal 4*d* linked with the damper lever 4*a*. The damper lever 4*a* is substantially parallel to the musical strings 5 at the home position thereof, and is rotatable around a pin member 4e coupled with a flange member 4f on the center rail 7. The damper head 4b is connected with the leading end of the damper lever 4a, and has a felt member 4g. A damper spring 4h is provided between the flange member 4f and the damper lever 4a, and urges the damper lever 4a in the clockwise direction. For this reason, while the key 1a is released, the damper lever 4a is in the home position thereof, and the felt member 4g is held in contact with the associated musical strings 5 for damping the musical strings. However, if the key 1a is depressed, the damper lever 4a is driven for rotation in the counter-clockwise direction, and the felt member 4g is left from the associated musical strings 5 so that the musical strings 5 can vibrate. In order to drive the damper lever 4a and, accordingly, the damper head 4b in the counter clockwise direction in synchronism with the key 1a, the driving link assembly 4c is provided between the key 1a and the damper lever 4a. The driving link assembly 4c comprises a damper rail 4i extending substantially in parallel to the key bed 1d, a flange 4j screwed into the damper rail 4i, and an arm member 4k rotatable around a pin member 4m with respect to the flange 4j. The arm member has a swingable member 4n inserted between the first capstan button 1c and the whippen heel 2f, and a damper spoon 4o projecting from the swingable member 4n and faced to the damper lever 4a. The damper spoon 4o serves as a kicker. The leading end of the damper spoon 4o is shaped into a spoon like configuration so as to smoothly slide on the damper lever 4a. An absorber is attached to the lower surface of the swingable member 2b and takes up the impact from the first capstan button 1c. On the contrary, the upper surface portion of the swingable member 4n is shaped into semi-spherical configuration, and the semi-spherical upper surface portion smoothly slides on the lower surface of the whippen heel 2f. The damper mechanism 4 is further associated with the damper pedal 4d, and the damper pedal 4d is linked with the damper lever 4a as described hereinbefore. While the damper pedal 4d is released, the damper lever 4a keeps the home position. However, when the damper pedal 4d is depressed, the damper lever 4a is driven for rotation in the counter clockwise direction, and the felt member 4g is spaced from the associated musical strings 5.

The upright piano thus arranged behaves as follows. Firstly, if the player does not depress the soft pedal 6a, the component mechanisms are held in the respective positions shown in FIG. 1. The bypass rail 8a is in the home position, and the first capstan button 1c is connected through the swingable member 4n with the whippen heel 2f. However, the drive button 8e is spaced from the lower surface of the whippen heel 2f. In this situation, when the key 1a is depressed, the key 1a is driven for rotation in the direction indicated by the arrow A, and the key motion is transmitted from the first capstan button 1c through the swingable member 8c to the whippen heel 2f. However, the drive button 8e keeps off the whippen heel 2f, because the drive button 8e closer to the center axis X than the first capstan button 1c travels rotational distance smaller than that of the first capstan button 1c. When the first capstan button 1c reaches the predetermined position, the driving link assembly 4c drives the damper lever 4a and, accordingly, the damper head 4b for rotation in the counter clockwise direction, and the felt member 4g is spaced from the musical strings 5. Thereafter, the jack 2d causes the butt 3a and, accordingly, the hammer wood 3c to rotate in the clockwise direction, and the hammer top felt 3d strikes the musical strings 5 for producing sound.

Subsequently, assuming now that the player depresses the soft pedal 6a, the hammer rail 6c rotates in the clockwise direction, and urges the hammer shank 3b and, accordingly, the hammer wood 3c to become closer to the musical strings 5. The soft pedal 6a further causes the bypass rail 8a to rotate in the counter clockwise direction, and the bypass rail 8a reaches the position shown in FIG. 2. While the bypass rail 8a is driven for rotation in the counter clockwise direction, the bypass lever 8c slides on the second capstan button 8f, and lift the drive button 8e. The drive button 8e thus lifted is firstly brought into abutting engagement with the whippen heel 2f, and, then, slightly urges the whippen heel 2f to move upwardly. The upward movement of the whippen heel 2f takes up gap produced between the jack 2d and the butt 3a, and keeps the jack 2d to be held in contact with the butt 3a. For this reason, the player does not feel the key-on under the manipulation of the soft pedal strange. However, the whippen heel 2f is spaced apart from the semi-spherical upper surface portion of the swingable member 4n, and gap takes place therebetween. Subsequently, the player depresses the key 1a under the manipulation of the soft pedal 6a, and the second capstan button 8f transmits the key motion through the bypass lever 8c and the drive button 8e to the whippen heel 2f. However, the first capstan button 1c does not urges the whippen heel 2f due to the gap between the swingable member 4n and the whippen heel 2f. Since the second capstan button 8f is closer to the center axis X than the first capstan button 1c, the rotating distance of the second capstan button 8f is smaller than that of the first capstan button 1c, and, for this reason, the rotating distance of the whippen 2b is decreased. When the key 1a rotates over the predetermined angle, the first capstan button 1c drives the swingable member 4n of the driving link assembly 4c, and the damper spoon 4o urges the damper lever to rotate in the direction allowing the felt member 4g to leave from the musical strings 5. Since the butt 3a has already rotated over a predetermined angle upon depressing the soft pedal 6a, the whippen 2b allows the jack 2d to terminate at the same position regardless of the manipulation of the soft pedal 6a. Therefore, the jack 2d drives the butt 3a as usual, and the player feels the keyon ordinary.

The hammer assembly 3 travels over the distance toward the musical strings 5 for striking the musical strings 5, and returns to the home position upon release of the key 1a. The damper spring 4h causes the damper lever 4a to rotate in the clockwise direction, and the felt member 4g is brought into contact with the musical strings 5 again.

Figure 3:
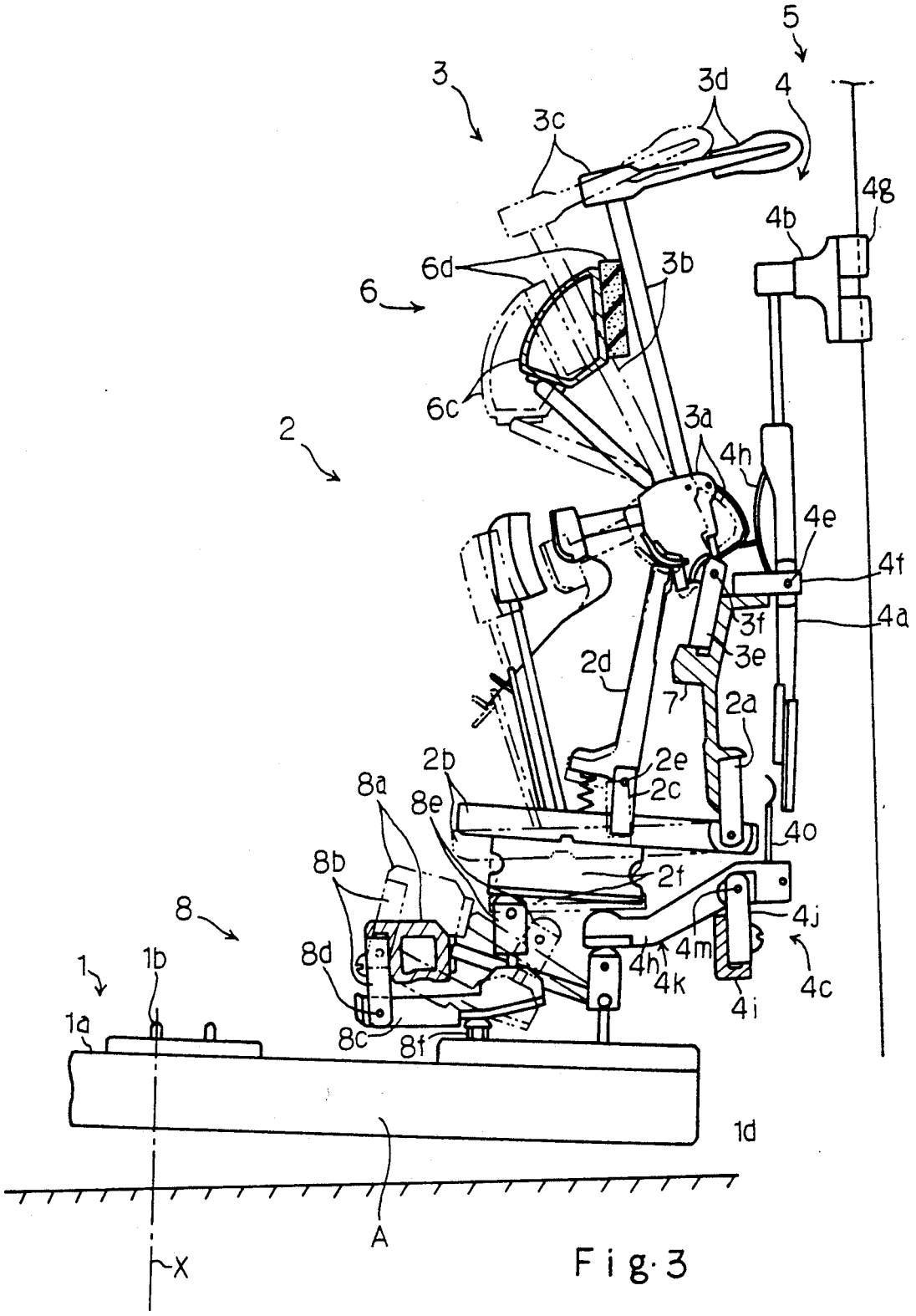
FIG. 3 is a partially cut-away side view for illustrating motion of the key action mechanism and the damper mechanism.

The whippen 2b is driven over the predetermined angle with the drive button 8e prior to the key-on as shown in FIG. 3. However, the rotation of the whippen 2b has no influence on the action of the damper mechanism 4, because the driving link assembly 4c directly transmits the key motion to the damper lever 4a independently from the whippen 2b. This result in that the player feels the keyon under the manipulation of the soft pedal 6a ordinary.

Second Embodiment

Figure 4:
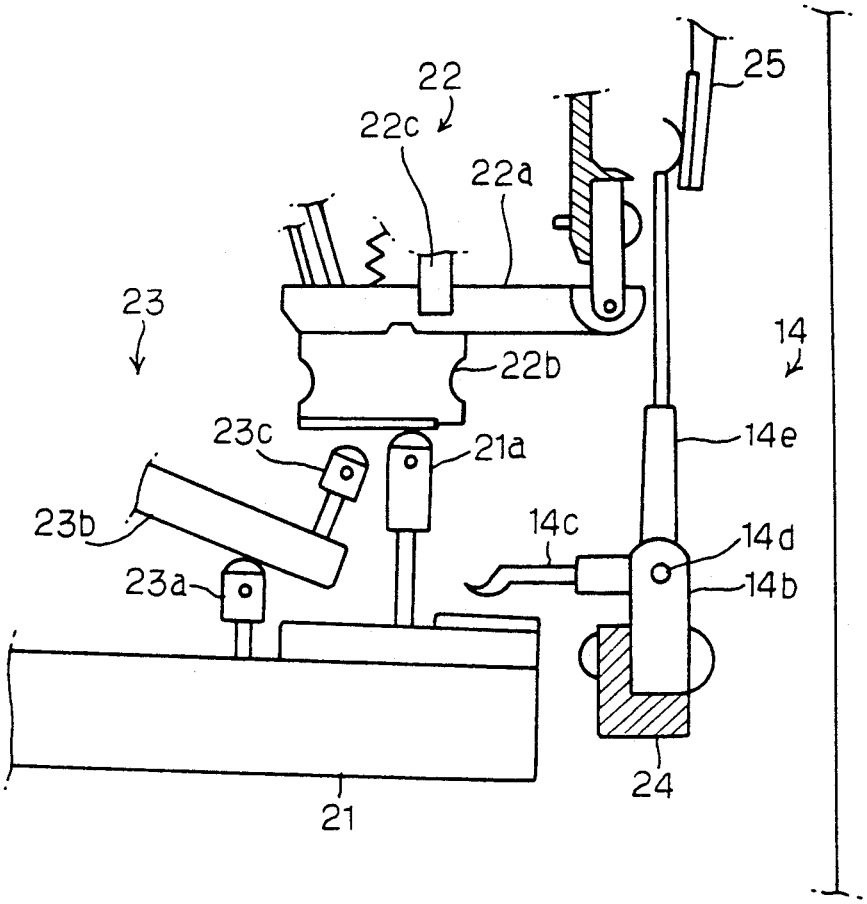
FIG. 4 is a side view showing an essential part of another key action mechanism according to the present invention.

Turning to FIG. 4 of the drawings, another driving link assembly 14 embodying the present invention is illustrated in FIG. 4 together with a key 21 with a first capstan button 21*a*, a key action mechanism 22 and an adjusting mechanism 23. Only a whippen 22*a*, a whippen heel 22*b* and a jack 22*c* are shown in FIG. 4, and a second capstan button 23*a*, a damper lever 23*b* and a drive button 23*c* stand for the adjusting mechanism 23.

The driving link assembly 14 comprises a flange 14*b* screwed into a damper rail 24, a swingable member 14*c* rotatable around a pin 14*d* with respect to the flange 14*b*, and a damper spoon 14*e* coupled with a boss portion of the swingable member 14*c* and driven for rotation together with the swingable member 14*c*. When the key 21 is depressed, the key per se is brought into contact with the swingable member 14*c*, and drives it for rotation in the clockwise direction. The damper spoon 14*e* presses the damper lever 25, and allows a felt member (not shown) to leave from associated musical strings. Since the key 21 directly drives the driving link assembly 14, and any movement of the whippen 22*a* has no influence on the action of a damper lever 25. For this reason, the player feels key-on ordinary regardless of manipulation of a soft pedal.

As will be appreciated from the foregoing description, the upright piano according to the present invention is equipped with the driving link assembly directly transmitting key motion to the damper mechanism, and the player feels key-on ordinary under manipulation of the soft pedal.

Although particular embodiments of the present invention have been shown and described, it will be obvious to those skilled in the art that various changes and modifications may be made without departing from the spirit and scope of the present invention. For example, any link arrangement is available for the driving link assembly in so far as the link arrangement bypasses the whippen.

What is claimed is:

1. An upright piano comprising:

a) a keyboard having at least one key rotatable with respect to a center axis, a first capstan button projecting from said at least one key;

b) at least one set of musical strings provided in association with said at least one key;

c) at least one hammer assembly having a butt, and rotatable from a home position toward said at least one set of musical strings for striking said at least one set of musical strings when said at least one key is depressed;

d) at least one key action mechanism having a rotatable whippen, a whippen heel attached to one surface of said whippen and a jack coupled with said whippen and held in contact with said butt, and operative to drive said at least one hammer assembly for rotation toward said at least one set of musical strings when said at least one key is depressed;

e) at least one damper mechanism having a rotatable damper lever held at a home position while said at least one key is released, and a first absorber supported by said rotatable damper lever and held in contact with said at least one set of musical strings while said rotatable damper lever is held at said home position, said damper lever allowing said first absorber to be spaced from said at least one set of musical strings when said at least one key is depressed;

f) a pedal mechanism linked with a soft pedal, and having a damper rail associated with a second absorber, said second absorber being spaced from said at least one hammer assembly while said soft pedal is released, said pedal mechanism causing said at least one hammer assembly to become closer to said at least one set of musical strings when said soft pedal is depressed;

g) an adjusting mechanism linked with said soft pedal, and having g-1) a second capstan button projecting from said at least one key and closer to said center axis of said at least one key than said first capstan button, g-2) a drive button spaced from said whippen heel when said soft pedal is released, and g-3) a transmission means slidable on said second capstan button and allowing said drive button to urge said whippen heel in a direction to increase distance between said first capstan button and said whippen heel when said soft pedal is depressed; and h) a driving link assembly driven for rotation independently from said whippen, and transmitting a key motion produced upon depressing said at least one key to said damper lever in a direction allowing said first absorber to be spaced from said at least one set of musical strings.

2. An upright piano as set forth in claim 1, in which said transmission means comprises g-3-1) a rotatable bypass rail linked with said soft pedal, g-3-2) a flange member downwardly projecting from said rotatable bypass rail, and g-3-3) a bypass lever rotatable with respect to said flange member, and slidable on said second capstan button, said drive button upwardly projecting from a leading end portion of said bypass lever.

3. An upright piano as set forth in claim 1, in which said driving link assembly includes h-1) a swingable member having a first end portion inserted between said first capstan button and said whippen heel when said soft pedal is released, and h-2) a kicker coupled with a second end portion of said swingable member opposite to said first end portion with respect to a center axis thereof, said kicker driving said damper lever to rotate in a direction allowing said first absorber to be spaced from said at least one set of musical strings when said at least one key is depressed.

4. An upright piano as set forth in claim 1, in which said driving link assembly includes a swingable member faced to said at least one key, and a kicker connected to said swingable member and driving said damper lever for rotation in a direction allowing said first absorber to be spaced from said at least one set of musical strings.

* * * * *